US007155384B2

(12) United States Patent
Banba

(10) Patent No.: US 7,155,384 B2
(45) Date of Patent: Dec. 26, 2006

(54) SPEECH CODING AND DECODING APPARATUS AND METHOD WITH NUMBER OF BITS DETERMINATION

(75) Inventor: Yutaka Banba, Yamato (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 810 days.

(21) Appl. No.: 10/277,827

(22) Filed: Oct. 23, 2002

(65) Prior Publication Data

US 2003/0093266 A1 May 15, 2003

(30) Foreign Application Priority Data

Nov. 13, 2001 (JP) ..... 2001-347408

(51) Int. Cl.
*G10L 19/02* (2006.01)

(52) U.S. Cl. ..... 704/212

(58) Field of Classification Search ..... None
See application file for complete search history.

(56) References Cited

U.S. PATENT DOCUMENTS

| | | | | |
|---|---|---|---|---|
| 5,214,741 | A * | 5/1993 | Akamine et al. | 704/274 |
| 5,436,899 | A * | 7/1995 | Fujino et al. | 370/433 |
| 5,493,647 | A | 2/1996 | Miyasaka et al. | |
| 5,870,405 | A * | 2/1999 | Hardwick et al. | 714/701 |
| 5,974,380 | A | 10/1999 | Smyth et al. | |
| 6,108,626 | A * | 8/2000 | Cellario et al. | 704/230 |
| 6,226,616 | B1 | 5/2001 | You et al. | |
| 6,243,673 | B1 | 6/2001 | Ohno | |
| 6,292,777 | B1 * | 9/2001 | Inoue et al. | 704/230 |
| 6,856,653 | B1 | 2/2005 | Taniguchi et al. | |
| 2005/0143973 | A1 | 6/2005 | Taniguchi et al. | |

FOREIGN PATENT DOCUMENTS

| | | |
|---|---|---|
| EP | 0433015 | 6/1989 |
| EP | 0433015 | 7/2001 |
| JP | 2-264520 | 10/1990 |
| JP | 3-181232 | 8/1991 |
| JP | 4-043400 | 2/1992 |
| JP | 5-181497 | 7/1993 |
| JP | 5-183523 | 7/1993 |
| JP | 6-069811 | 3/1994 |
| JP | 7-248798 | 9/1995 |
| JP | 7-253796 | 10/1995 |

(Continued)

OTHER PUBLICATIONS

English Language Abstract of JP 2-264520.

(Continued)

*Primary Examiner*—Susan McFadden
(74) *Attorney, Agent, or Firm*—Greenblum & Bernstein, P.L.C.

(57) ABSTRACT

An audio signal coding device, an audio signal decoding device and a method to improve audio quality. The audio signal coding device and method include a quantizer that quantizes a given signal according to a number of assigned bits in order to generate a codeword. The coding device includes an extractor that extracts core bits from the generated codeword. The coding device also includes a determiner that determines an optimal value of the number of assigned bits based on an energy level corresponding to the extracted core bits. The audio signal decoding device and method include a dequantizer that dequantizes a given codeword according to the number of assigned bits to generate a decoded signal. The decoding device includes an extractor that extracts core bits from the given codeword. The decoding device also includes a determiner that determines an optimal value of the number of assigned bits used in the dequantizer.

20 Claims, 8 Drawing Sheets

FOREIGN PATENT DOCUMENTS

| | | |
|---|---|---|
| JP | 97/21211 | 6/1997 |
| JP | 9-261064 | 10/1997 |
| JP | 0-501846 | 2/2000 |
| JP | 2001-007769 | 1/2001 |
| WO | 97/21211 | 6/1997 |
| WO | 00/079520 | 12/2000 |
| WO | 01/50458 | 7/2001 |

OTHER PUBLICATIONS

English Language Abstract of JP 5-183523.
English Language Abstract of JP 6-069811.
English Language Abstract of JP 7-248798.
English Language Abstract of JP 3-181232.
English Language Abstract of JP 9-261064.
English Language Abstract of JP 7-253796.
English Language Abstract of JP 4-043400.
English Language Abstract of JP 5-181497.
English Language Abstract of JP 2001-007769.
Iwadera et al., "A Robust 384kbits/s Stereo HiFi Audio Codec for ISDN Applications," IEEE proceedings of GLOBECOM'89 vol. 3 (Nov. 1989), pp. 1952-1956.

* cited by examiner

SPEECH CODING AND DECODING APPARATUS AND METHOD WITH NUMBER OF BITS DETERMINATION

BACKGROUND OF THE INVENTION

1. Field of the Invention

The present invention relates to a speech coding apparatus, speech decoding apparatus and speech coding/decoding method in sub-band ADPCM (Adaptive Differential Pulse Code Modulation).

2. Description of the Related Art

Conventionally, as a speech coding apparatus and speech decoding apparatus used in sub-band ADPCM, there are known apparatuses conforming to ITU-T (International Telecommunication Union Telecommunication sector) Recommendation G.722.

FIG. 1 is a block diagram illustrating configurations of speech coding apparatus 300 and speech decoding apparatus 400 used in two-sub-band ADPCM described in Recommendation G.722.

Speech coding apparatus 300 is comprised of 24-tap splitting filter bank 310 that splits a frequency band of an input signal to two sub-bands and outputs sub-band signals, ADPCM quantizers 320*a* and 320*b* that quantize respective two-split-sub-band signals, and multiplexer 330 that multiplexes codewords quantized in ADPCM quantizers 320*a* and 320*b* to produce a bit stream.

Meanwhile, speech decoding apparatus 400 is comprised of demultiplexer 410 that outputs codewords for each sub-band obtained from transmitted data streams, ADPCM dequantizers 420*a* and 420*b* that dequnantize respective codewords for each sub-band output from demuletiplexer 410 to output sub-band signals, and 24-tap synthesis filter bank 430 that performs synthesis filtering on the sub-band signals.

Operations of speech coding apparatus 300 and speech decoding apparatus 400 each configured as mentioned above will be described below.

A frequency band of an input signal is split to two sub-bands in splitting filter bank 310 and two sub-band signals are generated. Each of the sub-band signals is assigned a predetermined number of quantizing bits and quantized in respective one of ADPCM quantizers 320*a* and 320*b*. The codewords obtained by quantization are multiplexed in multiplexer 330 to be bit streams.

Meanwhile, in speech decoding apparatus 400, the bit streams with a plurality of multiplexed codewords are demulitiplexed in demultiplexer 410 to be codewords for each sub-band. The codewords for each sub-band obtained by demultiplexing are dequantized in ADPCM dequantizers 420*a* and 420*b* to be sub-band signals. The sub-band signals are subjected to synthesis in synthesis filter bank 430 to be a decoded signal.

However, in the conventional speech coding apparatus and speech decoding apparatus as described above, since the number of quantizing bits is fixed which is assigned to each sub-band signal in an ADPCM quantizer in the speech coding apparatus, in particular, when a sampling frequency of an input signal becomes high, there is a risk that the bit assignment is not optimal and that audio quality of decoded signals may deteriorate in the speech decoding apparatus.

SUMMARY OF THE INVENTION

It is an object of the present invention to improve the audio quality.

It is a subject matter of the present invention to in sub-band ADCPM coding in which residual signals between a plurality of sub-band signals for each frequency band split from an input signal and respective prediction values are each quantized, and each quantized output is dequantized to calculate a prediction value of a next frame of the sub-band signal, determine the number of quantizing bits assigned to a next frame of each residual signal in a process of calculating a prediction value of the next frame from a last frame, and thereby change the bit assignment adaptively.

According to an aspect of the invention, a speech coding apparatus that performs coding on speech signals in a sub-band ADPCM scheme has a generating section that quantizes a given sub-band signal according to the number of assigned bits to generate a codeword, and a determining section that determines an optimal value of the number of assigned bits used in the generating section.

According to another aspect of the invention, a speech decoding apparatus that performs decoding on speech signals in the sub-band ADPCM scheme has a generating section that dequantizes a given codeword according to the number of assigned bits to generate a decoded sub-band signal, and a determining section that determines an optimal value of the number of assigned bits used in the generating section.

According to still another aspect of the invention, a speech coding/decoding method for performing coding and decoding on speech signals in the sub-band ADPCM scheme has a determining step of determining an optimal value of the number of assigned bits to quantize a given sub-band signal, a quantizing step of quantizing the sub-band signal according to the determined optimal value of the number of assigned bits to generate a codeword, an acquiring step of acquiring the optimal value of the number of assigned bits based on the codeword, and a dequantizing step of dequantizing the codeword according to the acquired optimal value of the number of assigned bits to generate a decoded sub-band signal.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

Embodiments of the present invention will be described below specifically with reference to accompanying drawings.

(First Embodiment)

Figure 1:
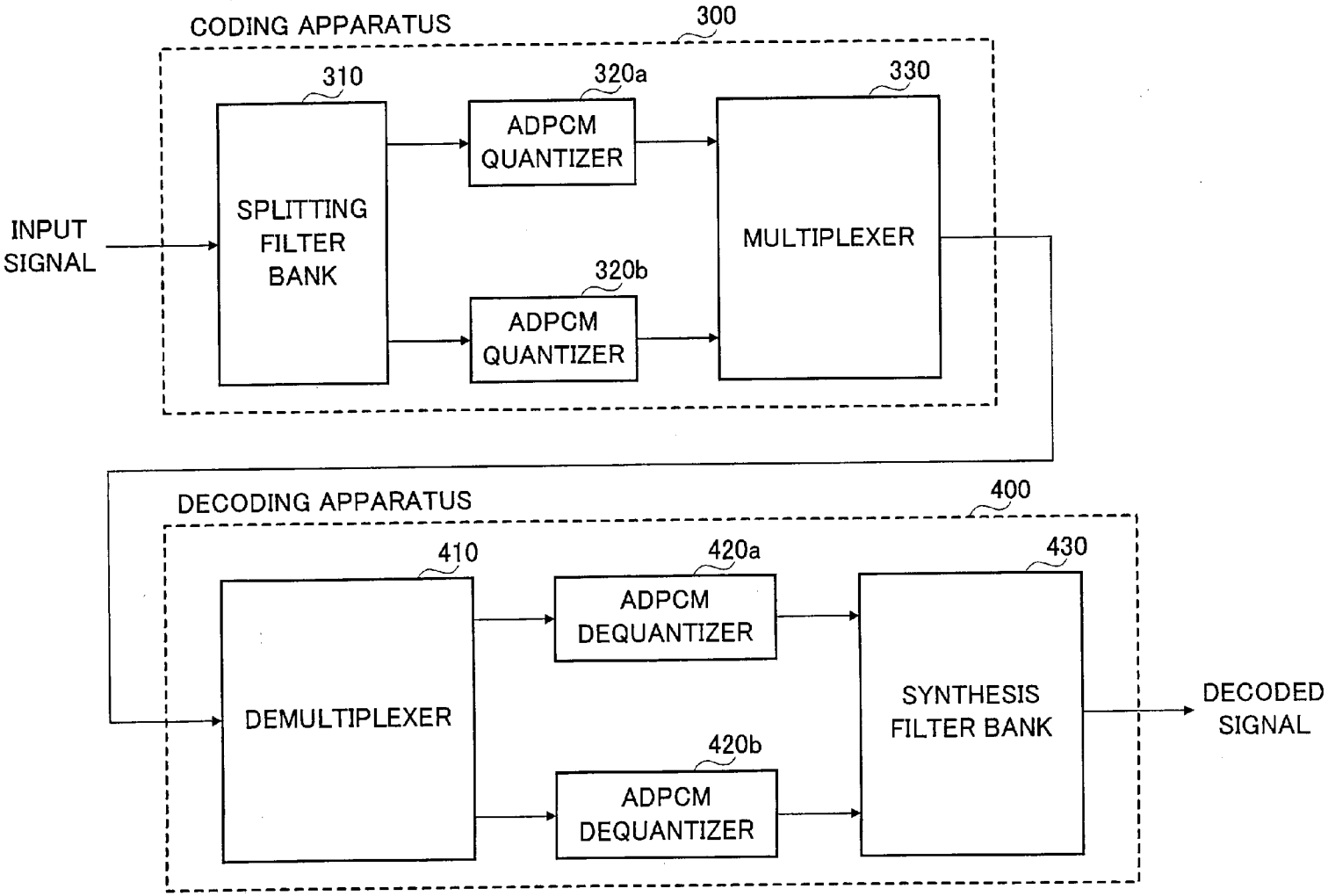
FIG. 1 is a block diagram illustrating configurations of a conventional speech coding apparatus and speech decoding apparatus used in two-sub-band ADPCM.
Figure 2:
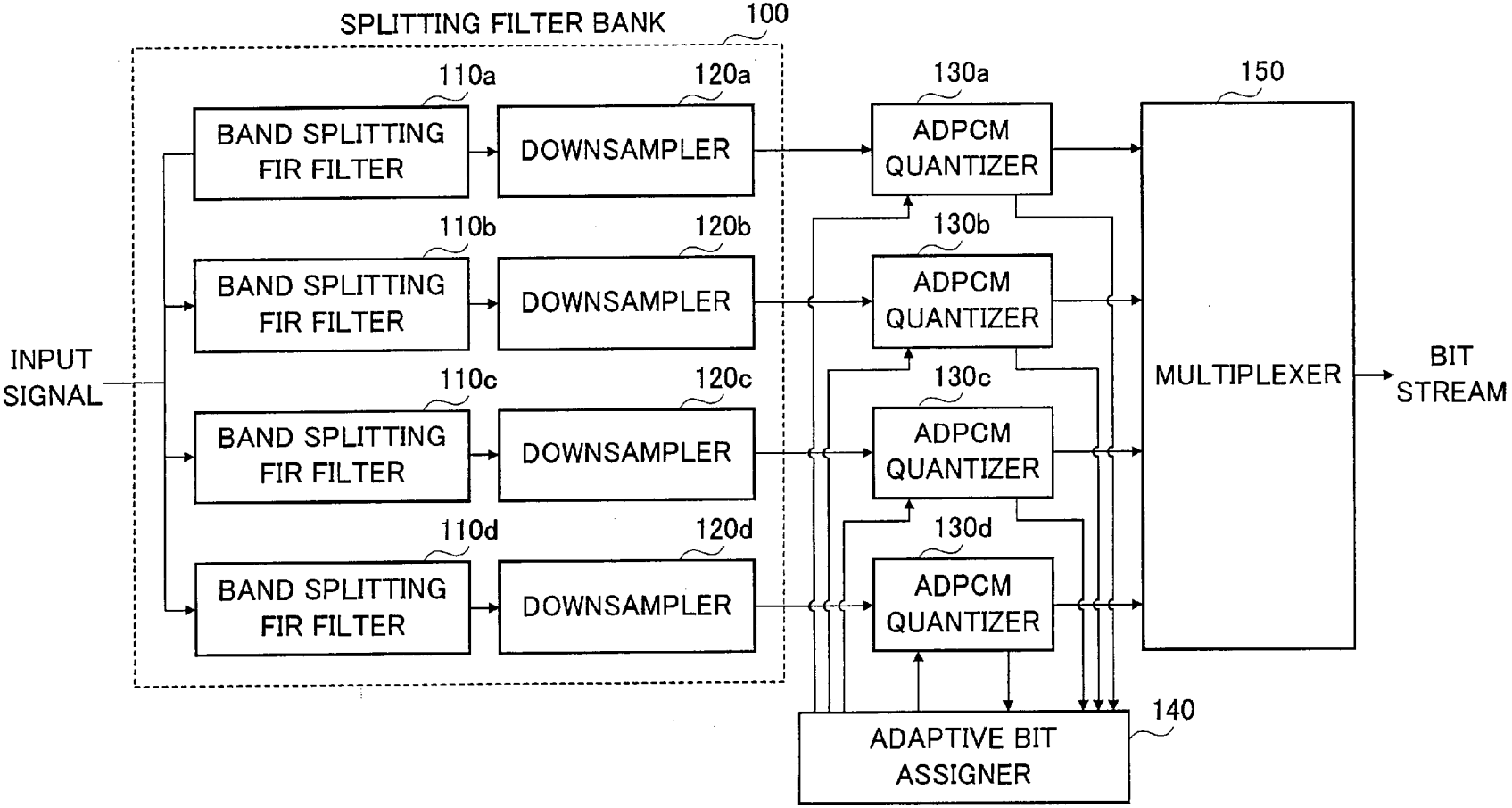
FIG. 2 is a block diagram illustrating a configuration of a speech coding apparatus according to first and second embodiments of the present invention.

FIG. 2 is a block diagram illustrating a configuration of a speech coding apparatus according to the first embodiment of the present invention. In FIG. 2, splitting filter bank 100 splits a frequency band of an input signal into four sub-bands with the same bandwidth, and performs thinning processing using "4" that is the number of splits, as a thinning number. Band splitting FIR filters 110*a* to 110*d* in splitting filter bank 100 perform splitting filtering on an input signal for predetermined frequency bands. Splitting filter bank 100 is a cosine modulation filter bank, and impulse responses of band splitting FIR filters 110*a* to 110*d* that are basic filters are asymmetric.

Further, downsamplers 120*a* to 120*d* in splitting filter bank 100 perform the thinning processing on respective outputs of band splitting FIR filters 110*a* to 110*d* for coding efficiency, using, as the number of thinning, "4" equal to the number of splits in splitting filter bank 100, and output respective sub-band signals.

Each of ADPCM quantizers 130*a* to 130*d* quantizes a residual signal between the respective sub-band signal and a prediction value calculated from the last frame of the sub-band signal to output a scalable codeword. Further, each of ADPCM quantizers 130*a* to 130*d* calculates a dequantized value and scale factor from the residual signal.

Adaptive bit assigner 140 determines the number of quantizing bits to assign to each of residual signals based on an energy value of the dequantized value calculated in respective one of ADPCM quantizers 130*a* to 130*d*.

Multiplexer 150 multiplexes codewords output from ADPCM quantizers 130*a* to 130*d* to produce a bit stream that is a multiplexed signal.

Figure 3:
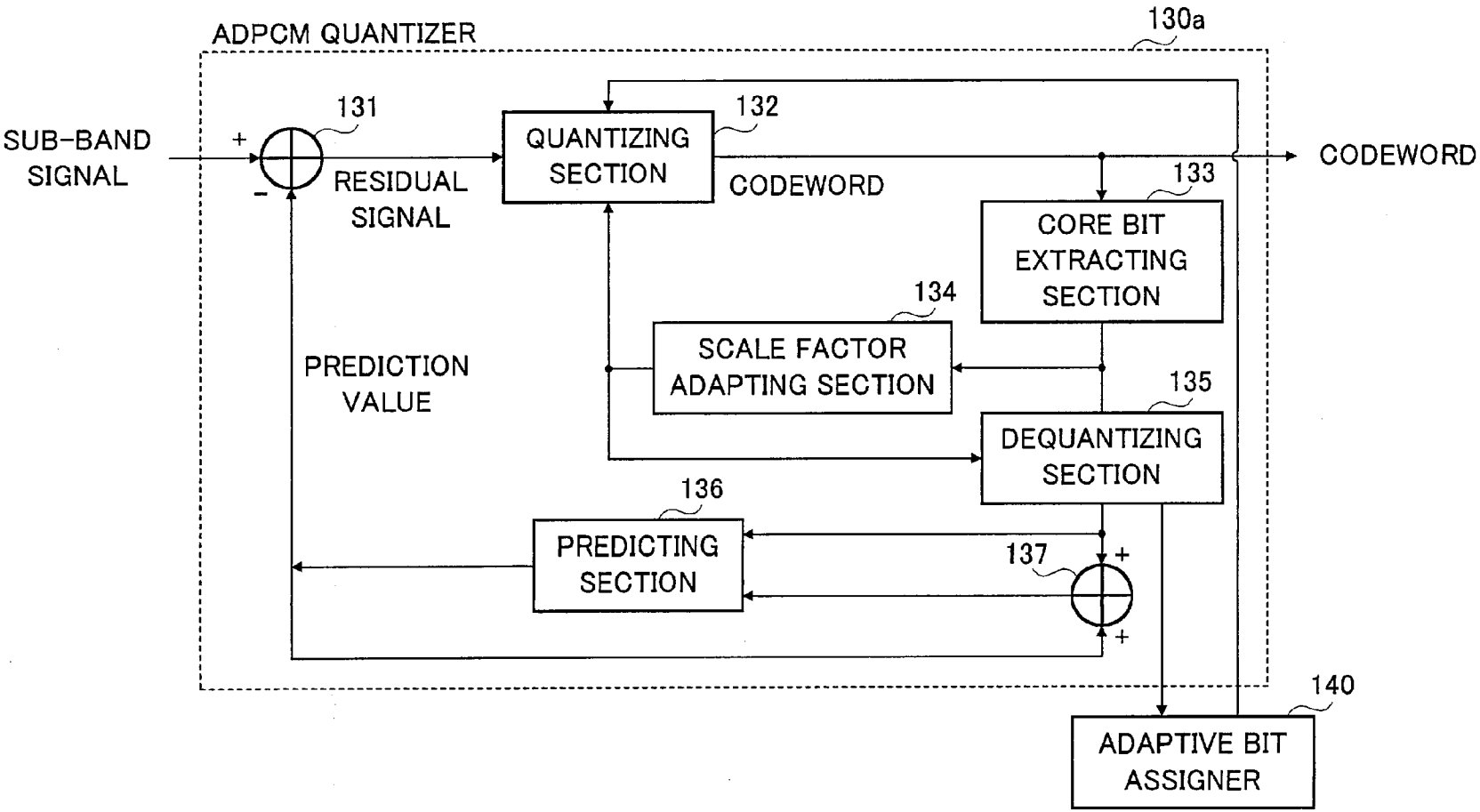
FIG. 3 is a block diagram illustrating a primary configuration of the speech coding apparatus according to the first embodiment of the present invention.

FIG. 3 is a block diagram illustrating a primary configuration of the speech coding apparatus according to the first embodiment of the present invention. While FIG. 3 illustrates a configuration of ADPCM quantizer 130*a* and adaptive bit assigner 140, the other ADPCM quantizers, 130*b* to 130*d*, have the same configuration as that of the quantizer 130*a* , and are connected to adaptive bit assigner 140.

In FIG. 3, adder 131 calculates a difference between the sub-band signal input to respective one of ADPCM quantizers 130*a* to 130*d* and a prediction value to generate a residual signal. Quantizing section 132 quantizes the generated residual signal using the scale factor, and outputs a codeword with the number of quantizing bits determined in adaptive bit assigner 140. Core bit extracting section 133 deletes least significant bits (hereinafter, referred to as "LSB") from the codeword output from quantizing section 132 to extract core bits. Scale factor adapting section 134 calculates a scale factor from the extracted core bits. Dequantizing section 135 dequantizes the extracted core bits, and outputs a dequantized value to predicting section 136, adder 137, and adaptive bit assigner 140. Predicting section 136 performs zero prediction and pole prediction using the dequantized value and an output of the predicting section 136, and calculates a prediction value of a next frame of the sub-band signal. Adder 137 calculates the sum of the dequantized value and the prediction value calculated in predicting section 136.

The operation of the speech coding apparatus configured as described above will be described next.

A speech signal input to the speech coding apparatus is split into four sub-band signals in splitting filter bank 100. Since splitting filter bank 100 is a cosine modulation filter bank and impulse responses of band splitting FIR filters 110*a* to 110*d* that are basic filters are asymmetric, a group delay occurring in filtering is decreased, and it is thereby possible to reduce an amount of computation. The split sub-band signals are input to ACDCM quantizers 130*a* to 130*d* respectively.

Adder 131 calculates a residual signal between the sub-band signal input to respective one of ADPCM quantizers 130*a* to 130*d* and a prediction value calculated from the last frame in predicting section 136, and inputs the calculated residual signal to quantizing section 132. The residual signal is quantized in quantizing section 132 to be a codeword with the number of quantizing bits assigned by adaptive bit assigner 140. Quantizing the residual signal uses the scale factor calculated in scale factor adapting section 134. The codeword quantized in quantizing section 132 is output to multiplexer 150, and also to core bit extracting section 133. The section 133 deletes LSB to extract core bits. The extracted core bits are input to scale factor adapting section 134 to be used in calculating a scale factor, and also to dequantizing section 135. Herein, the codeword quantized in quantizing section 132 becomes scalable to keep the consistency of the scale factor.

Dequantizing section 135 dequantizes the core bits using the scale factor calculated in scale factor adapting section 134. The dequantized value obtained by dequantizing the core bits is input to predicting section 136. This input value is called a zero prediction input value. The dequantized value is added in adder 137 to a prediction value of a last frame output from predicting section 136, and is input again to predicting section 136. This input value is called a pole prediction input value. Using the zero prediction input value and pole prediction input value, predicting section 136 calculates a prediction value of a next frame of the sub-band signal.

The dequantized value is input to adaptive bit assigner 140 per a predetermined number of frames such as a pitch period basis. Adaptive bit assigner 140 calculates an energy of the dequantized value, i.e., square sum of the dequantized value as a sample, output from each of ADPCM quantizers 130*a* to 130*d*, and based on the calculated energy of the dequantized value, determines the number of bits assigned to each residual signal to be quantized in respective one of ADPCM quantizers 130*a* to 130*d*.

The determined numbers of quantizing bits are output to respective quantizing sections 132 in ADPCM quantizers 130*a* to 130*d*. As described above, each quantizing section 132 quantizes the residual signal of the next frame using the scale factor, and outputs a codeword with the number of assigned bits. Codewords quantized in ADPCM quantizers 130*a* to 130*d* are multiplexed in multiplexer 150 to be a bit stream that is a multiplexed signal.

Figure 4:
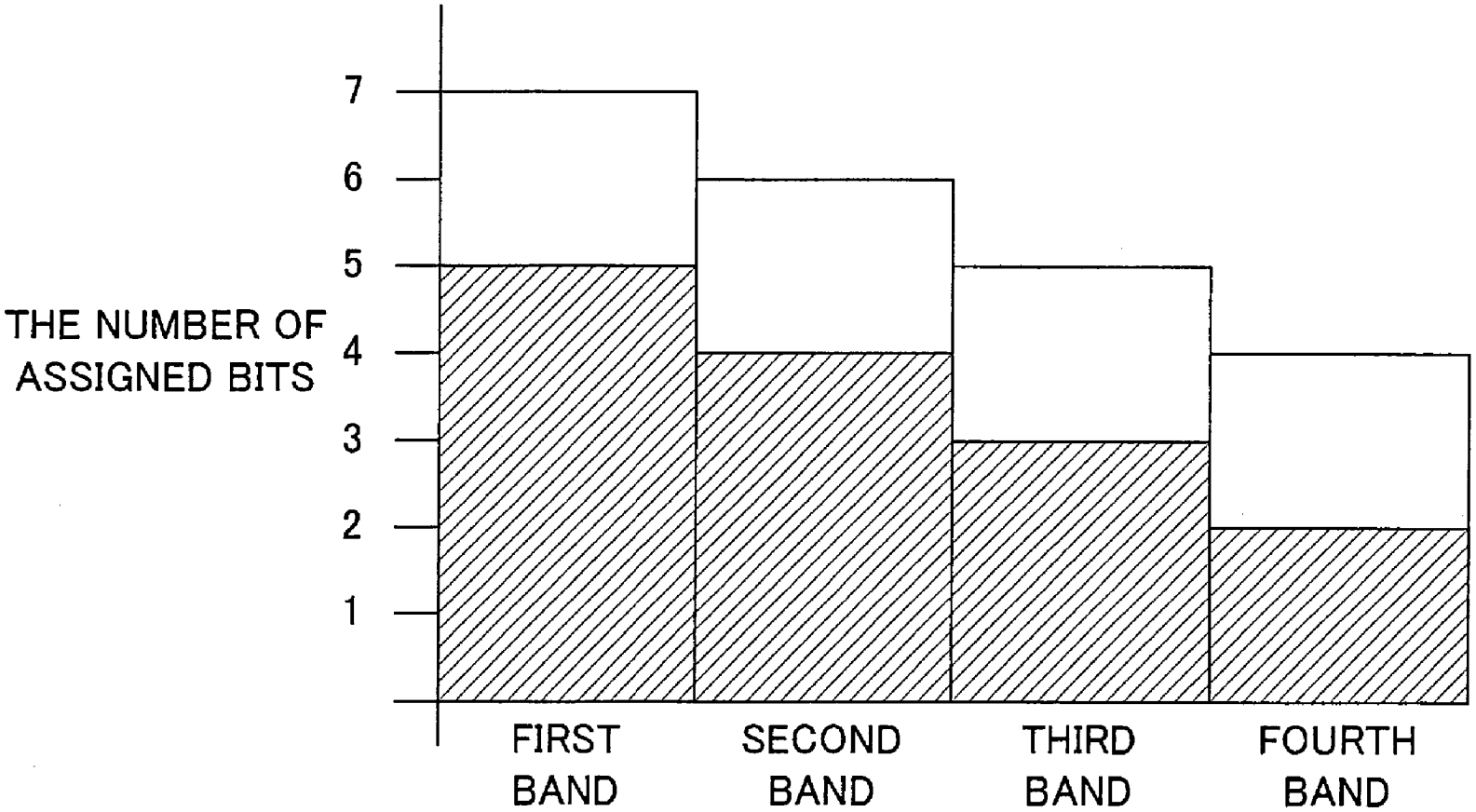
FIG. 4 is a view showing an example of quantizing bit number assignment according to the first embodiment of the present invention.

FIG. 4 illustrates an example of quantizing bit number assignment. In FIG. 4, bits shown by oblique line indicate core bits in each band. The number of the core bits is five in the first band, four in the second band, three in the third band and two in the fourth band. The core bits are always constant in every band, and bits assigned adaptively by adaptive bit assigner 140 are two bits shown by white in FIG. 4. The two bits are assigned adaptively to each band corresponding to the energy of the dequantized value.

A speech decoding apparatus according to the first embodiment will be described below.

Figure 5:
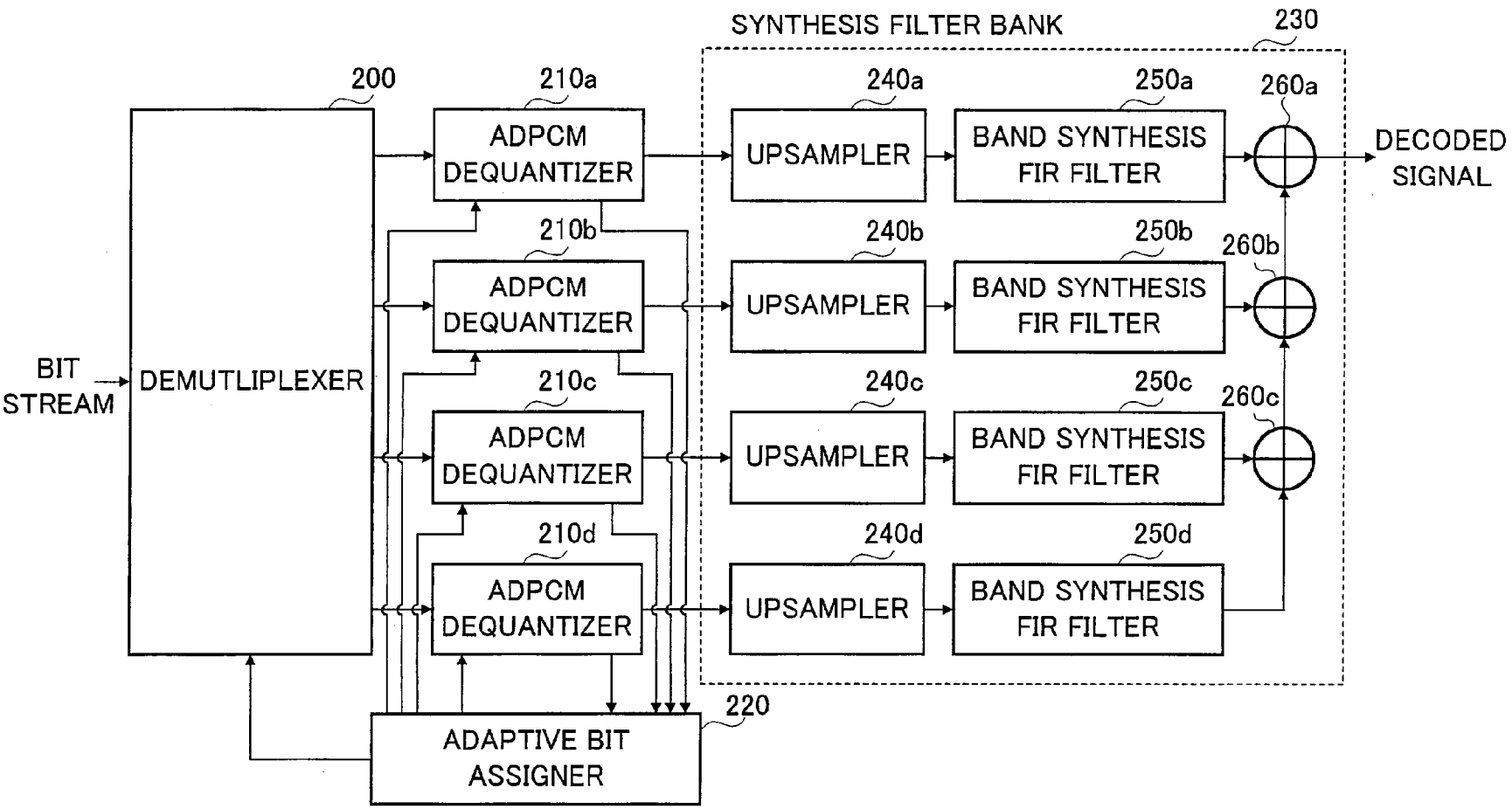
FIG. 5 is a block diagram illustrating a configuration of a speech decoding apparatus according to the first and second embodiments of the present invention.

FIG. 5 is a block diagram illustrating a configuration of the speech decoding apparatus according to the first embodiment of the present invention. In FIG. 5, demultiplexer 200 decomposes an input bit stream every a number of bits assigned by adaptive bit assigner 220 described later and thus splits the bit stream into codewords for each sub-band. Each of ADPCM dequantizers 210*a* to 210*d* outputs a sum of a decoded residual signal obtained by dequantizing a respective codeword and a prediction value calculated from a codeword of a last frame as a decoded sub-band signal. Further, each of ADPCM dequantizers 210*a* to 210*d* calculates a dequantized value of only core bits obtained by deleting LSB from the codeword, and the scale factor. Based on the energy of the dequantized value of the core bits calculated in each of ADPCM dequantizers 210*a* to 210*d*, adaptive bit assigner 220 calculates the number of quantizing bits assigned to the respective residual signal in the speech coding apparatus.

Synthesis filter bank 230 combines decoded sub-band signals output from ADPCM dequantizers 210*a* to 210*d* to obtain a decoded signal. Upsamplers 240*a* to 240*d* in synthesis filter bank 230 perform interpolation of thinned respective decoded sub-band signals. Band synthesis FIR filters 250*a* to 250*d* in synthesis filter bank 230 perform synthesis filtering on respective interpolated decoded sub-band signals. Synthesis filter bank 230 is a cosine modulation filter bank, and impulse responses of band synthesis FIR filters 250*a* to 250*d* that are basic filters are asymmetric.

Figure 6:
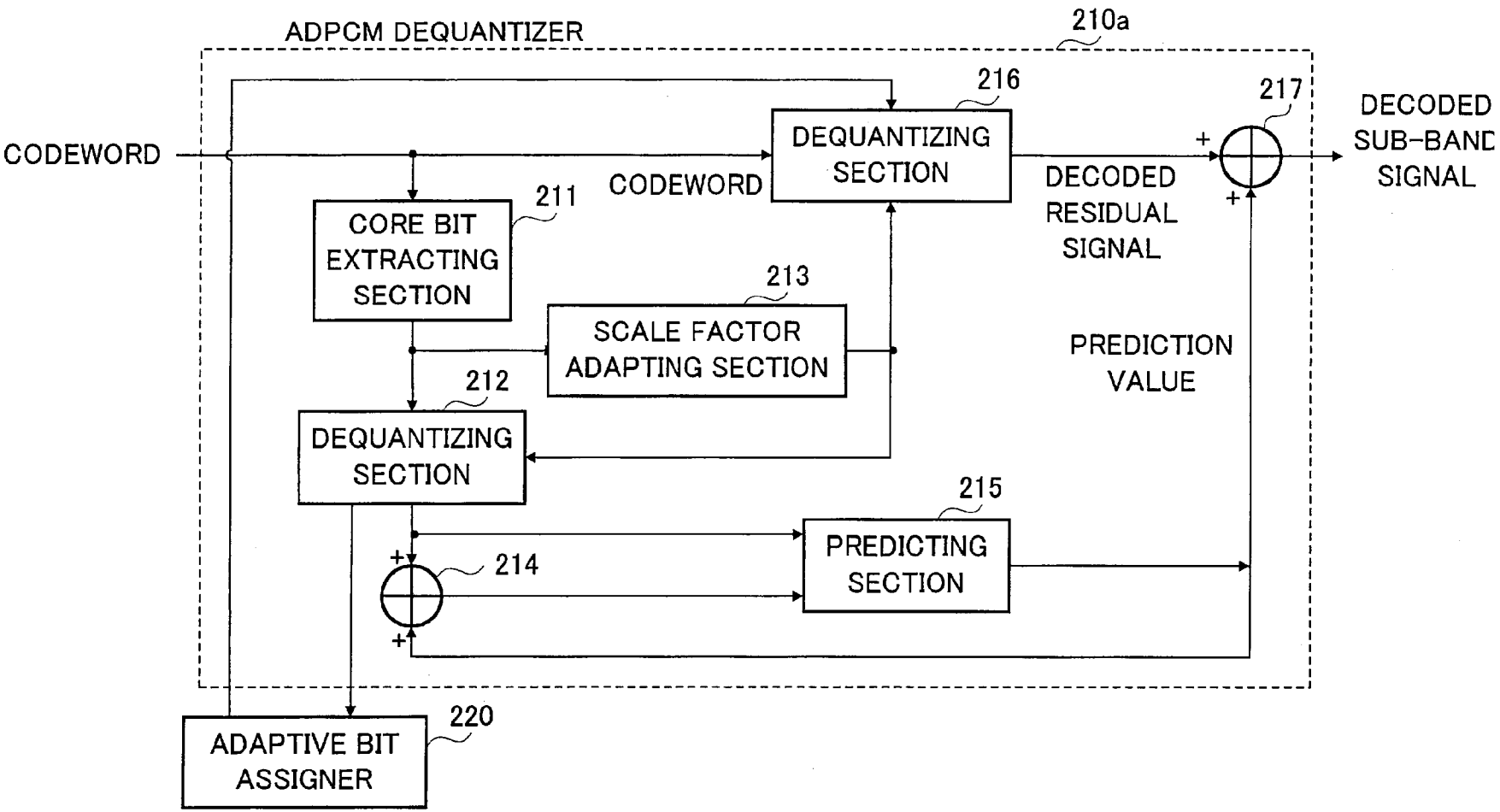
FIG. 6 is a block diagram illustrating a primary configuration of the speech decoding apparatus according to the first embodiment of the present invention.

FIG. 6 is a block diagram illustrating a primary configuration of the speech decoding apparatus according to the first embodiment of the present invention. While FIG. 6 illustrates a configuration of ADPCM dequantizer 210*a* and adaptive bit assigner 220, the other ADPCM dequantizers, 210*b* to 210*d*, have the same configuration as that of the dequantizer 210*a* , and are connected to adaptive bit assigner 220.

In FIG. 6, core bit extracting section 211 deletes LSB from the codeword input to respective one of ADPCM dequantizers 210*a* to 210*d* to extract core bits. Dequantizing section 212 dequantizes the extracted core bits, and outputs a dequantized value to adder 214, predicting section 215, and adaptive bit assigner 220. Scale factor adapting section 213 calculates a scale factor from the extracted core bits. Adder 214 calculates the sum of the dequantized value and the prediction value calculated in predicting section 215. Predicting section 215 performs zero prediction and pole prediction using the dequantized value and an output of the prediction section 215, and calculates a prediction value of a next frame of the decoded sub-band signal. Dequantizing section 216 dequantizes the input codeword every a number of quantizing bits calculated in adaptive bit assigner 220 using the scale factor, and outputs a decoded residual signal. Adder 217 calculates the sum of the decoded residual signal output from dequantizing section 216 and the prediction value to generate a decoded sub-band signal.

The operation of the speech decoding apparatus configured as described above will be described next.

A bit stream input to the speech decoding apparatus is decomposed per a number of quantizing bits assigned by bit assigner 220, and thus split into codewords every four sub-bands. The split codewords are input to respective ADPCM dequantizers 210*a* to 210*d*.

The codeword input to each of the ADPCM dequantizers 210*a* to 210*d* is dequantized in dequantizing section 216 corresponding to the number of quantizing bits assigned by adaptive bit assigner 220 and output as a decoded residual signal. From the codeword input to respective one of ADPCM dequantizers 210*a* to 210*d*, LSB is deleted and core bits are extracted in core bit extracting section 211. The extracted core bits are input to scale factor adapting section 213 to be used in calculating a scale factor, and also to dequantizing section 212. In dequantizing section 212, the core bits are dequantized using the scale factor calculated in scale factor adapting section 213. The dequantized value obtained by dequantizing the core bits is input to predicting section 215. This input value is called a zero prediction input value. The dequantized value is added in adder 214 to a prediction value of a last frame output from predicting section 215, and is input again to predicting section 215. This input value is called a pole prediction input value. Using the zero prediction input value and pole prediction input value, predicting section 215 calculates a prediction value of a next frame of the decoded sub-band signal.

The dequantized value is input to adaptive bit assigner 220 per a predetermined number of frames such as a pitch period basis. Adaptive bit assigner 220 calculates an energy of the dequantized value, i.e., square sum of the dequantized value as a sample, output from the each of ADPCM dequantizers 210*a* to 210*d*, and based on the calculated energy of the dequantized value, calculates the number of quantizing bits assigned to each residual signal quantized in respective one of ADPCM quantizers 130*a* to 130*d* in the speech coding apparatus.

The calculated numbers of quantizing bits are output to dequantizing section 216 in respective one of ADPCM dequantizers 210*a* to 210*d*, and as described above, dequantizing section 216 dequantizes a codeword of a next frame using the scale factor corresponding to the number of bits assigned in adaptive bit assigner 220 and outputs a decoded residual signal. The output decoded residual signal is added in adder 217 to the prediction value output from predicting section 215 to be a decoded sub-band signal, and the decoded sub-band signal is output from each of ADPCM dequantizers 210*a* to 210*d*.

The decoded sub-band signals dequantized in ADPCM dequantizers 210*a* to 210*d* are subjected to interpolation in upsamplers 240*a* to 240*d* in synthesis filter bank 230, and to synthesis filtering in band synthesis FIR filters 250*a* to 250*d*. The respective outputs from band synthesis FIR filters 250*a* to 250*d* are added in adders 260*a* to 260*c* to be a decoded signal. Herein, since synthesis filter bank 230 is a cosine modulation filter bank and impulse responses of band synthesis FIR filters 250*a* to 250*d* that are basic filters are asymmetric, a group delay occurring in filtering is decreased, and it is thereby possible to reduce an amount of computation.

Thus, according to the speech coding apparatus and speech decoding apparatus of this embodiment, in the speech coding apparatus, a residual signal between a sub-band signal for each frequency band and a prediction value is quantized to output to a codeword, the output codeword is dequantized to calculate an energy of the dequantized value, and the number of quantizing bits assigned in quantizing a next frame of each residual signal is determined based on the calculated energy. In the speech decoding apparatus, the same codeword as that dequantized in the speech coding apparatus is dequantized to calculate the energy of the dequantized value, and based on the calculated energy, the number of quantizing bits is calculated which is determined in the speech coding apparatus to assign to a next frame of each residual signal. As a result, the speech coding apparatus is capable of assigning the number of quantizing bits adaptively to each residual signal, and even when the speech coding apparatus changes the number of assigned quantizing bits, the speech decoding apparatus is capable of performing dequantization in sync with changes in the bit assignment in the speech coding apparatus without obtaining information of the changed bit assignment. Accordingly, since the speech coding apparatus does not need to notify the speech decoding apparatus of the information of the changed bit assignment to synchronize, it is possible to improve the audio quality without degrading the transmission efficiency of speech information.

(Second Embodiment)

It is a feature of the speech coding apparatus and speech decoding apparatus according to the second embodiment of the present invention to use a scale factor in determining an optimal value of the number of quantizing bits. In addition, configurations of the speech coding apparatus and speech decoding apparatus according to the second embodiment are the same as those of the speech coding apparatus and speech decoding apparatus illustrated in FIGS. 2 and 5 of the first embodiment, respectively, and descriptions thereof are omitted.

Figure 7:
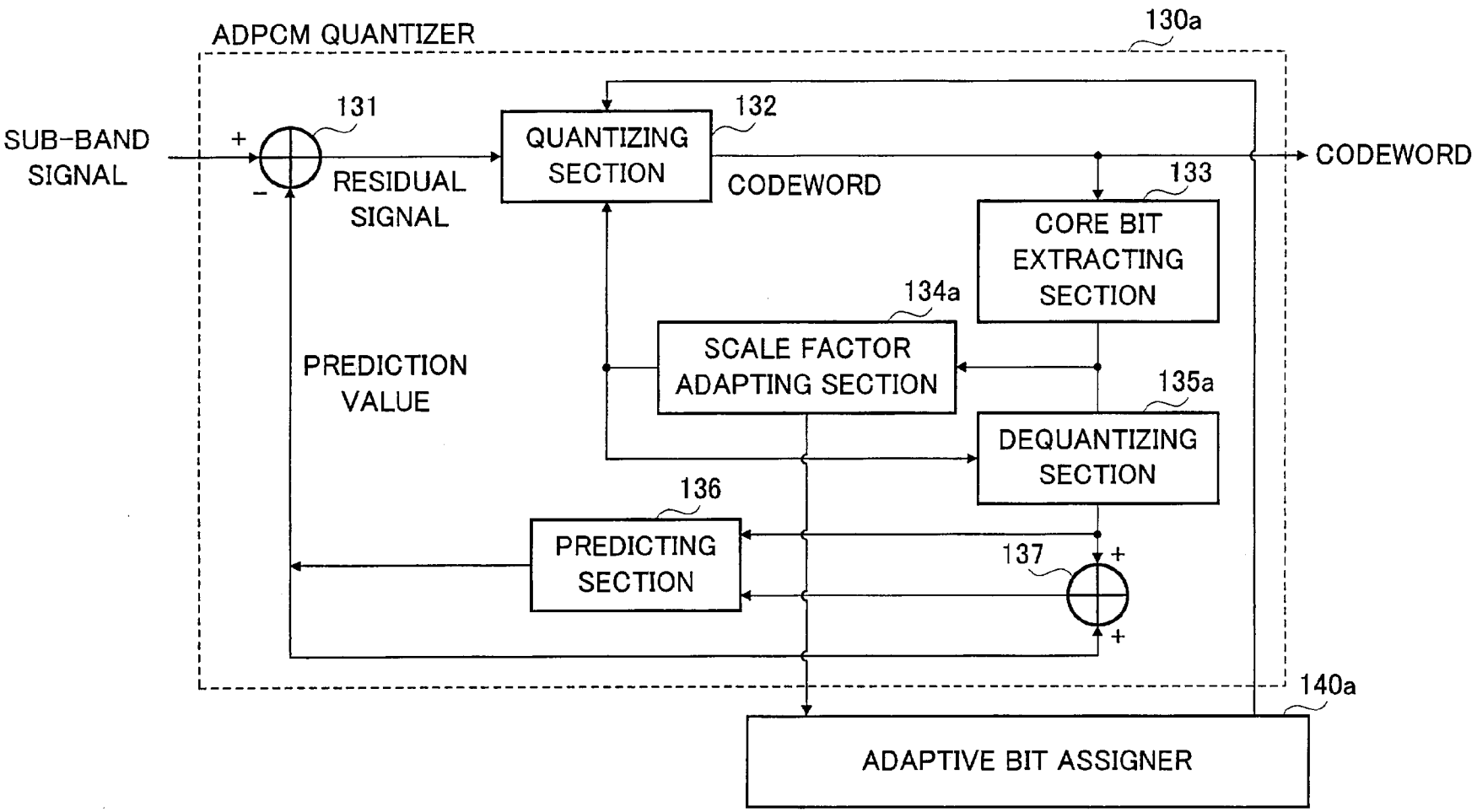
FIG. 7 is a block diagram illustrating a primary configuration of the speech coding apparatus according to the second embodiment of the present invention.

FIG. 7 is a block diagram illustrating a primary configuration of the speech coding apparatus according to the second embodiment of the present invention. While FIG. 7 illustrates a configuration of ADPCM quantizer 130*a* and adaptive bit assigner 140*a*, the other ADPCM quantizers, 130*b* to 130*d*, have the same configuration as that of the quantizer 130*a*, and are connected to adaptive bit assigner 140*a*. Further, the same sections as in FIG. 3 are assigned the same reference numerals to omit descriptions thereof.

In FIG. 7, scale factor adapting section 134*a* calculates a scale factor from the core bits extracted in core bit extracting section 133 to output to adaptive bit assigner 140*a*. Dequantizing section 135*a* dequantizes the core bits extracted in core bit extracting section 133, and outputs a dequantized value to predicting section 136 and adder 137. Adaptive bit assigner 140*a* determines the number of quantizing bits to assign to each of residual signals based on a scale factor calculated in respective one of ADPCM quantizers 130*a* to 130*d*.

The operation of the speech coding apparatus configured as described above will be described next.

Sub-band signals split in splitting filter bank 100 are input to ADPCM quantizers 130*a* to 130*d* respectively. Adder 131 calculates a residual signal between the sub-band signal input to respective one of the ADPCM quantizers 130*a* to 130*d* and a prediction value of a last frame calculated in predicting section 136, and inputs the calculated residual signal to quantizing section 132. The residual signal is quantized in quantizing section 132 to be a codeword with the number of quantizing bits assigned by adaptive bit assigner 140*a*. Quantizing the residual signal uses the scale factor calculated in scale factor adapting section 134*a*. The codeword quantized in quantizing section 132 is output to multiplexer 150, and also to core bit extracting section 133. The section 133 deletes LSB to extract core bits. The extracted core bits are input to scale factor adapting section 134*a* to be used in calculating a scale factor, and also to dequantizing section 135*a*. Herein, the codeword quantized in quantizing section 132 becomes scalable to keep the consistency of the scale factor.

Dequantizing section 135*a* dequantizes the core bits using the scale factor calculated in scale factor adapting section 134*a*. From the dequantized value obtained by dequantizing the core bits, predicting section 136 calculates a prediction value of a next frame of the sub-band signal.

The scale factor is input to adaptive bit assigner 140*a* per a predetermined number of frames such as a pitch period basis. Adaptive bit assigner 140*a* considers as an energy an average value of scale factors output from of ADPCM quantizers 130*a* to 130*d*, and as in the first embodiment, determines the number of quantizing bits assigned to each residual signal to be quantized in respective one of ADPCM quantizers 130*a* to 130*d*.

The determined numbers of quantizing bits are output to respective quantizing sections 132 in ADPCM quantizers 130*a* to 130*d*. As described above, each quantizing section 132 quantizes the residual signal of the next frame using the scale factor, and outputs a codeword with the number of assigned bits. Codewords quantized in ADPCM quantizers 130*a* to 130*d* are multiplexed in multiplexer 150 to be a bit stream that is a multiplexed signal.

The speech decoding apparatus according to the second embodiment of the present invention will be described below. A configuration of the speech decoding apparatus according to the second embodiment is the same as that of the speech decoding apparatus illustrated in FIG. 5 of the first embodiment, and descriptions thereof are omitted.

Figure 8:
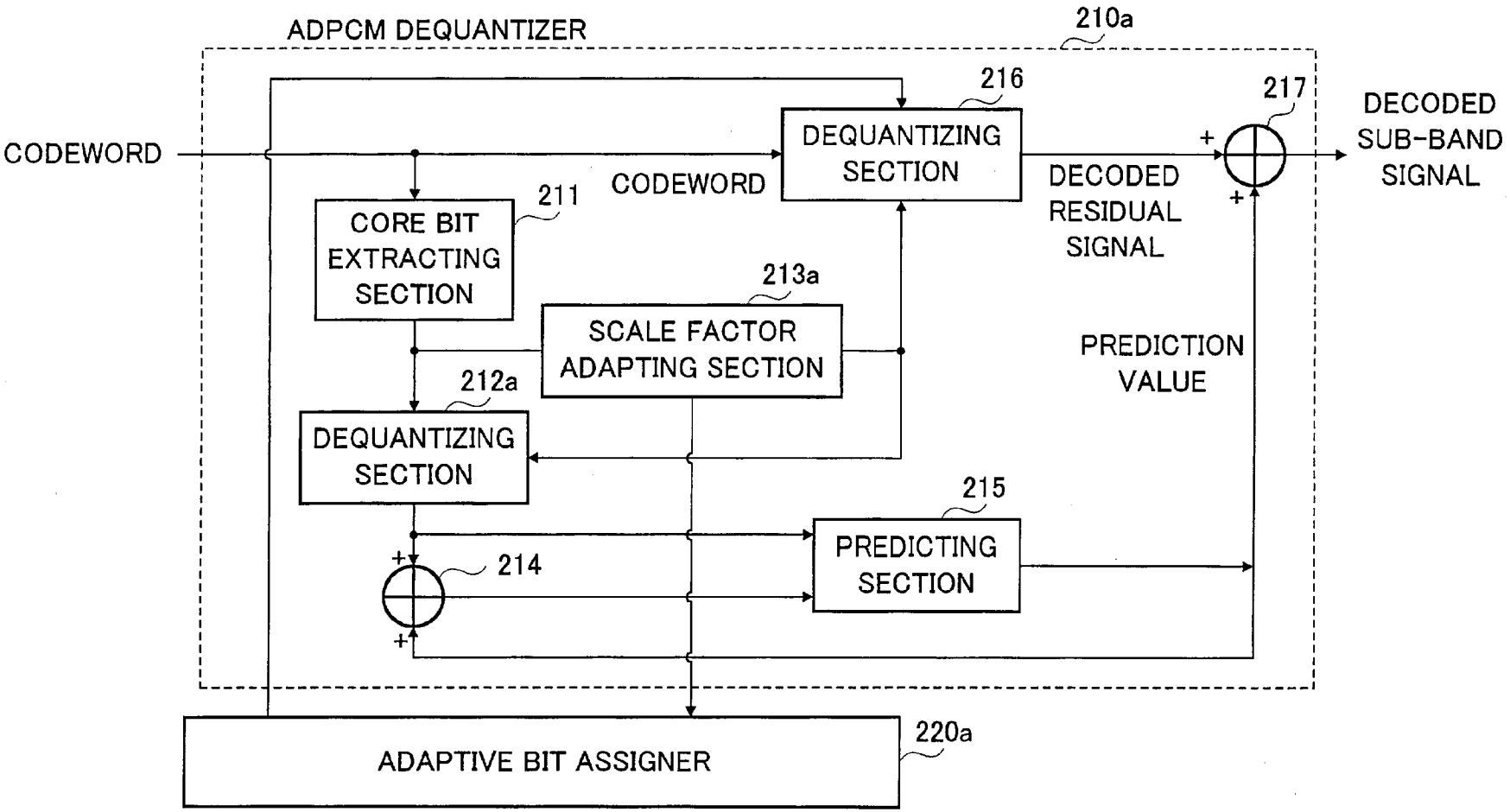
FIG. 8 is a block diagram illustrating a primary configuration of the speech decoding apparatus according to the second embodiment of the present invention.

FIG. 8 is a block diagram illustrating a primary configuration of the speech decoding apparatus according to the second embodiment of the present invention. While FIG. 8 illustrates a configuration of ADPCM dequantizer 210*a* and adaptive bit assigner 220*a*, the other ADPCM dequantizers, 210*b* to 210*d*, have the same configuration as that of the dequantizer 210*a*, and are connected to adaptive bit assigner 220*a*.

In FIG. 8, core bit extracting section 211 deletes LSB from the codeword input to respective one of ADPCM dequantizers 210*a* to 210*d* to extract core bits. Dequantizing section 212*a* dequantizes the extracted core bits, and outputs a dequantized value to adder 214 and predicting section 215. Scale factor adapting section 213*a* calculates a scale factor from the extracted core bits to output to adaptive bit assigner 220*a*. Adder 214 calculates the sum of the dequantized value and the prediction value calculated in predicting section 215. Predicting section 215 performs zero prediction and pole prediction using the dequantized value and an output of the prediction section 215, and calculates a prediction value of a next frame of the decoded sub-band signal. Dequantizing section 216 dequantizes the input codeword every a number of quantizing bits calculated in adaptive bit assigner 220*a* using the scale factor, and outputs a decoded residual signal. Adder 217 calculates the sum of the decoded residual signal output from dequantizing section 216 and the prediction value to generate a decoded sub-band signal. Adaptive bit assigner 220*a* determines the number of quantizing bits to assign to each of residual signals based on a scale factor calculated in respective one of ADPCM dequantizers 210*a* to 210*d*.

The operation of the speech decoding apparatus configured as described above will be described next.

Codewords split in demultiplexer 200 are input to respective ADPCM dequantizers 210*a* to 210*d*. The codeword input to each of ADPCM dequantizers 210*a* to 210*d* is dequantized in dequantizing section 216 corresponding to the number of quantizing bits assigned by adaptive bit assigner 220*a*, and a decoded residual signal is output. From the codeword input to respective one of ADPCM dequantizers 210*a* to 210*d*, LSB is deleted and core bits are extracted in core bit extracting section 211. The extracted core bits are input to scale factor adapting section 213*a* to be used in calculating a scale factor, and also to dequantizing section 212*a*. In dequantizing section 212*a*, the core bits are dequantized using the scale factor calculated in scale factor adapting section 213*a*. The dequantized value obtained by dequantizing the core bits is input to predicting section 215. Predicting section 215 calculates a prediction value of a next frame of the decoded sub-band signal using the input dequantized value.

The scale factor is input to adaptive bit assigner 220*a* per a predetermined number of frames such as a pitch period basis. Adaptive bit assigner 220*a* considers as an energy an average value of scale factors output from of ADPCM dequantizers 210*a* to 210*d*, and as in the first embodiment, calculates the number of quantizing bits assigned to each residual signal quantized in respective one of ADPCM quantizers 130*a* to 130*d*.

The calculated numbers of quantizing bits are output to dequantizing section 216 in respective one of ADPCM dequantizers 210*a* to 210*d*, and as described above, dequantizing section 216 dequantizes a codeword of a next frame using the scale factor corresponding to the number of bits assigned in adaptive bit assigner 220*a* and outputs a decoded residual signal. The output decoded residual signal is added in adder 217 to the prediction value output from predicting section 215 to be a decoded sub-band signal, and the decoded sub-band signal is output from each of ADPCM dequantizers 210*a* to 210*d*. The decoded sub-band signals dequantized in respective ADPCM dequantizers 210*a* to 210*d* are subjected to synthesis in synthesis filter bank 230 to be a decoded signal.

Thus, according to the speech coding apparatus and speech decoding apparatus of this embodiment, in the speech coding apparatus, a residual signal between a sub-band signal for each frequency band and a prediction value is quantized to output a codeword, a scale factor is calculated from core bits of the output codeword, and based on the calculated scale factor, the number of quantizing bits assigned in quantizing a next frame of each residual signal is determined. In the speech decoding apparatus, the scale factor is calculated using the same codeword as that dequantized in the speech coding apparatus, and based on the calculated scale factor, the number of quantizing bits is calculated which is determined in the speech coding apparatus to assign to a next frame of each residual signal. As a result, the speech coding apparatus is capable of assigning the number of quantizing bits adaptively to each residual signal, and even when the speech coding apparatus changes the number of assigned quantizing bits, the speech decoding apparatus is capable of performing dequantization in sync with changes in the bit assignment in the speech coding apparatus without obtaining information of the changed bit assignment. Accordingly, it is possible to improve the audio quality without degrading the transmission efficiency of speech information.

In addition, while each of the above-mentioned embodiments describes the case where an input signal is split into four sub-band signals in a splitting filter bank, the present invention is not limited to such a case, and it is only required to split an input signal into more than two signals corresponding to frequency band. In addition, increasing the number of splits provides smoothing on signals to be quantized, and improves the following characteristic of scale factor. Further, when a splitting filter bank is a cosine modulation filter, increasing the number of splits increases the number of taps of basic filter and suppress increases in delay amount.

As described above, according to the present invention, it is possible to provide a speech coding apparatus, speech decoding apparatus and speech coding/decoding method enabling improved audio quality.

The present invention is not limited to the above described embodiments, and various variations and modifications may be possible without departing from the scope of the present invention.

This application is based on the Japanese Patent Application No. 2001-347408 filed on Nov. 13, 2001, entire content of which is expressly incorporated by reference herein.

What is claimed is:

1. A coding apparatus for coding audio signals in a sub-band scheme, the coding apparatus comprising:

a quantizer that quantizes a sub-band signal in accordance with a number of assigned bits to generate a codeword;

an extractor that extracts core bits from the generated codeword; and a determiner that determines an optimal value of the number of assigned bits based on an energy level corresponding to the extracted core bits.

2. The coding apparatus according to claim 1, further comprising:

a dequantizer that dequantizes the extracted core bits to output a dequantized signal.

3. The coding apparatus according to claim 2, wherein the determiner determines the optimal value of the number of assigned bits based on the energy level of the dequantized signal during a pitch period.

4. The coding apparatus according to claim 1, further comprising:

a scale factor adapter that acquires a scale factor from the extracted core bits, and wherein the determiner determines the optimal value of the number of assigned bits based on the scale factor acquired in the scale factor adapter.

5. The coding apparatus according to claim 4, further comprising:

a dequantizer that dequantizes the extracted core bits to output a dequantized signal, and wherein the determiner determines the optimal value of the number of assigned bits based on the scale factor during a pitch period.

6. The coding apparatus according to claim 1, wherein the quantizer generates scalable codewords.

7. The coding apparatus according to claim 1, further comprising:

a splitter that splits an input signal into at least one sub-band signal, wherein the at least one sub-band signal comprises at least one freguency band;

the splitter comprising a cosine modulation filter bank, the cosine modulation filter bank comprises a basic filter having an asymmetric impulse response.

8. A decoding apparatus that performs decoding on audio signals in a sub-band scheme, comprising:

an extractor that extracts core bits from a codeword;

a first dequantizer that dequantizes the codeword according to a number of assigned bits to generate at least one decoded sub-band signal; and a determiner that determines an optimal value of the number of assigned bits based on an energy level corresponding to the extracted core bits.

9. The decoding apparatus according to claim 8, further comprising:

a second dequantizer that dequantizes the extracted core bits to generate a dequantized signal, and wherein the determiner determines an optimal value of the number of assigned bits based on an energy level of the dequantized signal.

10. The decoding apparatus according to claim 9, wherein the determiner determines the optimal value of the number of assigned bits based on the energy level of the dequantized signal during a pitch period.

11. The decoding apparatus according to claim 8, further comprising:

a scale factor adapter that acquires a scale factor from the extracted core bits, and wherein the determiner determines the optimal value of the number of assigned bits based on the scale factor acquired in the scale factor adapter.

12. The decoding apparatus according to claim 11, further comprising:

a second dequantizer that dequantizes the extracted core bits to output a dequantized signal, and wherein the determiner determines the optimal value of the number of assigned bits based on the scale factor during a pitch period.

13. The decoding apparatus according to claim 8, further comprising:

a synthesizer that synthesizes the at least one decoded sub-band signal, the synthesizer comprising a cosine modulation filter bank, and the cosine modulation filter bank comprising a basic filter having an asymmetric impulse response.

14. A method for coding audio signals in a sub-band scheme, the method comprising:

quantizing a sub-band signal according to a number of assigned bits to generate a codeword;

extracting core bits from the generated codeword; and acquiring an optimal value of the number of assigned bits based on an energy level corresponding to the extracted core bits, wherein the sub-band signal is quantized in accordance with the acquired optimal value.

15. The method according to claim 14, further comprising:

dequantizing the generated codeword to generate a dequantized signal; and determining the energy level based on the dequantized signal.

16. The method according to claim 14, further comprising:

calculating a scale factor from the extracted core bits; and determining the optimal value of the number of assigned bits based on the calculated scale factor.

17. The method according to claim 15, further comprising generating a prediction value based on the dequantized signal.

18. A method for decoding audio signals in a sub-band scheme, the method comprising:

dequantizing a codeword in accordance with a number of assigned bits to generate at least one decoded sub-band signal;

extracting core bits from the codeword;

acquiring an optimal value of the number of assigned bits based on an energy level corresponding to the extracted core bits, wherein the codeword is dequantized in accordance with the acquired optimal value.

19. The method according to claim 18, further comprising:

dequantizing the extracted core bits to generate a dequantized signal; and determining the energy level based on the dequantized signal.

20. The method according to claim 18, further comprising:

calculating a scale factor from the extracted core bits; and determining the optimal value of the number of assigned bits based on the calculated scale factor.

* * * * *